United States Patent [19]

Akesaka

[11] Patent Number: 5,061,120

[45] Date of Patent: Oct. 29, 1991

[54] DIRECTION CORRECTING DEVICE FOR SHIELD TUNNELLING MACHINE

[75] Inventor: Toshio Akesaka, Yokohama, Japan

[73] Assignee: Kabushiki Kaisha Iseki Kaihatsu Koki, Tokyo, Japan

[21] Appl. No.: 555,298

[22] Filed: Jul. 18, 1990

[30] Foreign Application Priority Data

Jul. 19, 1989 [JP] Japan ..... 1-184526

[51] Int. Cl.[5] ..... E21D 9/06

[52] U.S. Cl. ..... 405/143; 299/1; 405/184

[58] Field of Search ..... 405/141, 142, 143, 184; 299/1, 55

[56] References Cited

U.S. PATENT DOCUMENTS 3,854,775 12/1974 Anderson ..... 299/1
4,436,448 3/1984 Magnus et al. ..... 405/143
4,508,390 4/1985 Bessac ..... 405/143 X

FOREIGN PATENT DOCUMENTS 61-23356 6/1986 Japan .
61-47956 10/1986 Japan .

*Primary Examiner*—David H. Corbin
*Assistant Examiner*—Arlen L. Olsen
*Attorney, Agent, or Firm*—Stoel Rives Boley Jones & Grey

[57] ABSTRACT

A direction correcting device for a shield tunnelling machine having a shield body provided with a head portion and a tail portion following the head portion corrects the direction of the head portion relative to the tail portion. The device includes three jacks, each jack having two connecting portions relatively displaced in the axial direction of the tail portion, and a connecting body for interconnecting the head portion and the tail portion to permit the head portion and the tail portion to swing and to prevent the head portion and the tail portion from relatively displacing in the axial direction of the tail portion. Each of the jacks is connected at one connecting portion to the head portion and connected at the other connecting portion to the tail portion. The jacks and the connecting body are disposed around the axis of the tail portion at angular intervals.

6 Claims, 4 Drawing Sheets

DIRECTION CORRECTING DEVICE FOR SHIELD TUNNELLING MACHINE

BACKGROUND OF THE INVENTION

1. Field of the Invention

This invention relates to a direction correcting device for a shield tunnelling machine having a shield body provided with a head portion and a tail portion following the head portion. More particularly, the invention relates to a device that corrects the excavating direction of the head portion relative to the tail portion.

2. Description of the Prior Art

As one direction correcting device for a shield tunnelling machine, Japanese Publication No. 6123356 discloses a device including four double-acting hydraulic jacks disposed around the axis of a tail portion at equal angular intervals, each jack having one end connected to a head portion and the other end connected to the tail portion.

In this known direction correcting device, four jacks are divided into two sets, with one set of jacks disposed above the horizontal line passing through the axis of the tail portion and the other set of jacks disposed below the above-mentioned horizontal line. When the one set of jacks are respectively extended (or contracted) and the other set of jacks are respectively contracted (or extended), the head portion is directed upward (or downward) relative to the tail portion. Alternatively, the four jacks are divided into two sets, with one set of jacks disposed leftward of the vertical line passing through the axis of the tail portion and the other set of jacks disposed rightward of the above-mentioned vertical line. When the one set of jacks are respectively extended (or contracted) and the other set of jacks are respectively contracted (or extended), the head portion is directed leftward (or rightward) relative to the tail portion.

As another direction correcting device, Japanese Patent Publication No. 61-47956 discloses a device including a rod, having one end connected to a head portion and the other end connected to a tail portion and being disposed on the vertical line orthogonal to the axis of the tail portion, and two hydraulic jacks, each jack having one end connected to the head portion and the other end connected to the tail portion and being disposed symmetrically about the above-mentioned vertical line.

In this known direction correcting device, when both jacks are respectively extended or contacted, the head portion is directed upward or downward relative to the tail portion. Also, when one jack is extended and the other jack is contracted, the head portion is directed leftward or rightward relative to the tail portion.

However, since the direction correcting device disclosed in Japanese Patent Publication No. 61-23356 requires four jacks, the structure, such as piping for fluid to operate the jacks, is complicated. Also, in the direction correcting device disclosed in Japanese Patent Publication No. 61-47956, since the rod and two jacks receive loads acting on the head portion and the tail portion in the advancing and direction correcting operations, large-sized jacks are needed.

SUMMARY OF THE INVENTION

It is an object of the present invention to provide a direction correcting device for a shield tunnelling machine, which does not need large-sized-jacks and has a simple structure.

A direction correcting device according to the present invention for a shield body that is provided with a head portion and a tail portion following the head portion corrects the direction of the head portion relative to the tail portion. The device includes three jacks, each jack having two connecting portions relatively displaced in the axial direction of the tail portion, and a connecting body for interconnecting the head portion and the tail portion to permit the head portion and the tail portion to swing and to prevent the head portion and the tail portion from relatively displacing in the axial direction of the tail portion. Each jack is connected at one connecting portion to the head portion and connected at the other connecting portion to the tail portion. The jacks and the connecting body are disposed around the axis of the tail portion at angular intervals.

When one of the two jacks adjacent to the connecting body and the jack that is not adjacent to the connecting body are extended or contracted together, the head portion is directed upward or downward relative to the tail portion. Alternatively, when the other one of the two jacks adjacent to the connecting body and the jack that is not adjacent to the connecting body are extended or contracted together, the head portion is directed leftward or rightward relative to the tail portion.

The direction correcting device according to the present invention requires only three jacks, therefore structure, such as piping for fluid to operate the jacks, is simplified in comparison with the prior art device including four jacks. Also, since the load between the head portion and the tail portion acts on the connecting body and three jacks, the direction correcting device according to the present invention may use smaller-sized jacks in comparison with the prior art device including one connecting body and two jacks.

The jacks and the connecting body of the present invention are preferably disposed along an imaginary circle around the axis of the tail portion at equal angular intervals. Thus, by equalizing the extended and contracted amounts of both jacks when the head portion is corrected vertically relative to the tail portion to those of both jacks when the head portion is corrected leftward or rightward relative to the tail portion, the correcting amount in the vertical direction is made equal to that in the leftward or rightward direction.

The connecting body may include a rod having two connecting portions incapable of relative displacement in the axial direction of the tail portion. The rod of this embodiment of the present invention is connected at one connecting portion to the head portion and connected at the other connecting portion to the tail portion.

Double-acting hydraulic jacks having two liquid chambers defined by a piston sliding within a cylinder are used in the apparatus of the present invention.

Further, the direction correcting device according to the present invention includes a pump for supplying pressurized fluid to the jacks for operation thereof; a solenoid operated change-over valve corresponding to each of the jacks and disposed between the corresponding jack and the pump to change over pressurized fluid flow paths, each of the flow paths being individually connected to the liquid chamber; a control circuit for controlling current applied to the change-over valves; and a check valve disposed in each of the flow paths and permitting the pressurized fluid to be supplied to the corresponding liquid chamber, while preventing the pressurized fluid from flowing out of the corresponding liquid chamber. The check valve also permits the pressurized fluid to flow out of the corresponding liquid chamber when pressure acts on the other flow path paired with the above-mentioned flow path.

When each of the change-over valves corresponding to the jacks adjacent to the connecting body is a P-port, block type valve, and the change-over valve corresponding to the remaining jack is an open center type, three-position four-port valve, the open center type valve serves as an unloading valve when each jack is in its neutral position. As a result, the pump is always operated without hindering the normal operation of each jack and without using the unloading valve.

BRIEF DESCRIPTION OF THE DRAWINGS

The foregoing and other objects and features of the invention will become apparent from the following description of a preferred embodiment of the invention with reference to the accompanying drawings, in which.

DETAILED DESCRIPTION OF THE PREFERRED EMBODIMENTS

Figure 1:
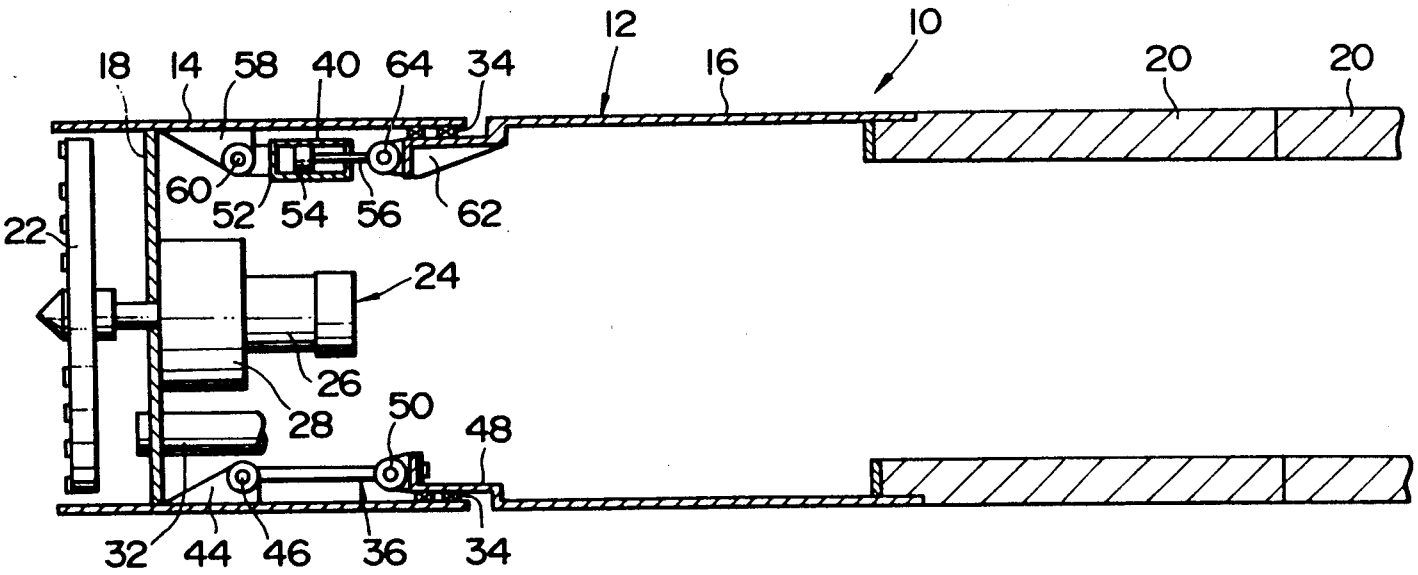
FIG. 1 is a sectional view of an embodiment of a shield tunnelling machine provided with a direction correcting device of the present invention.
Figure 2:
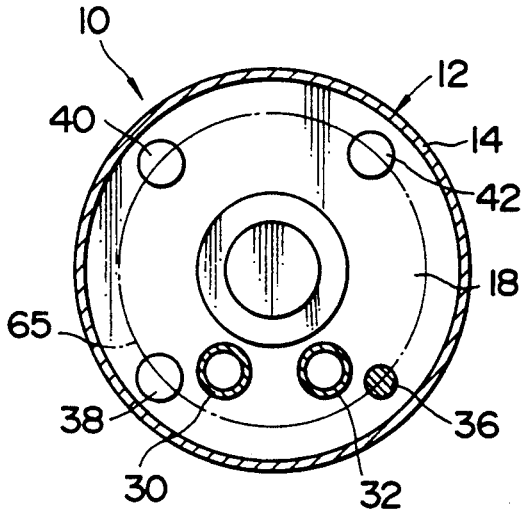
FIG. 2 is a rear view of an embodiment of a shield tunnelling machine provided with a direction correcting device of the present invention showing the positional relationship between the rod and the jacks.

Referring to FIGS. 1 and 2, a shield tunnelling machine 10 comprises a shield body 12 divided into a cylindrical head portion 14 and a cylindrical tail portion 16 connected to the rear of head portion 14 through a direction correcting device of the present invention. The internal space of head portion 14 is defined by a partition wall 18 into a facing-side front region of partition wall 18 and a rear region of partition wall 18 communicating with the internal space of tail portion 16.

Shield body 12 receives thrust from a thrusting device (not shown) installed in a shaft (not shown) through a pipe 20 following tail portion 16. In this manner, shield body 12 is advanced together with pipe 20. However, when applying the direction correcting device according to the present invention to a large-sized shield tunnelling machine, the thrust of shield body 12 is provided by a plurality of jacks, and a lining built up in the rear of shield body 12 serves as a reaction body.

Shield tunnelling machine 10 is used in a pipe propulsion engineering method for thrusting a pipe while excavating a facing. Thus, shield tunnelling machine 10 further includes a cutter assembly 22 for excavating the facing. The direction correcting device of the present invention may be also applied to shield tunnelling machine 10 used in a pipe propulsion engineering method without using cutter assembly 22.

Cutter assembly 22 is disposed in the front region of partition wall 18 and supported by partition wall 18 so that cutter assembly 22 is rotated around the axis of head portion 14. Cutter assembly 22 is rotated by a rotary mechanism 24 mounted to partition wall 18 to excavate the facing. Rotary mechanism 24 is provided with a rotary source 26, like a motor, and a reduction gear 28 connected to an output shaft of rotary source 26 and cutter assembly 22.

A muddy water supply pipe 30 and a drain pipe 32 that are opened to the front region of partition wall 18 are mounted to partition wall 18. Earth and sand excavated by cutter assembly 20 are drained to the rear of shield tunnelling machine 10 through drain pipe 32 together with muddy water supplied from supply pipe 30 to the front region of partition wall 18. Collapse of the facing is prevented as a result of pressure in the front region of partition wall 18.

A front end of tail portion 16 is formed into a small-diameter portion and is swingably received inside a rear end of head portion 14. A plurality of annular seal members 34 are disposed between the outer periphery of the rear end of head portion 14 and the inner periphery of the front end of tail portion 16. By this, liquid tightness between head portion 14 and tail portion 16 is maintained.

The direction correcting device for swinging head portion 14 relative to tail portion 16 comprises a rod 36 and three jacks 38, 40 and 42 having the same shape and the same dimension.

A front end of rod 36 is connected to a bracket 44 provided on head portion 14 through a joint 46, so that the front end of rod 36 is rotated around the axis extending in the horizontal direction orthogonal to the axial direction of head portion 14. A rear end of rod 36 is connected to a bracket 48 provided on tail portion 16 through a universal joint 50, so that the rear end of rod 36 is rotated around the axis extending in the horizontal direction orthogonal to the axial direction of tail portion 16 and around the axis extending in the vertical direction. In this manner, head portion 14 is made swingable relative to tail portion 16 is prevented from displacement in the axial direction of tail portion 16 relative to tail portion 16.

However, the front end of rod 36 and head portion 14 may be interconnected to rotate around the axis extending in the horizontal direction orthogonal to the axial direction of head portion 14 and also around the axis extending in the vertical direction, and the rear end of rod 36 and tail portion 16 may be interconnected to rotate around the axis extending in the horizontal direction orthogonal to the axial direction of tail portion 16. Also, a universal joint may be used for interconnecting the front end of rod 36 and head portion 14 and/or for interconnecting the rear end of rod 36 and tail portion 16 to permit rotation of the two interconnected members around two axes orthogonal to each other. Further, head portion 14 and tail portion 16 may be directly interconnected through the universal joint to be rotated around two axes orthogonal to each other.

Each jack 38, 40 and 42, as shown by exemplary jack 40 in FIG. 1, is a double-acting jack that has two liquid chambers defined by a piston 54 sliding within a cylinder 52, permitting a rod 56 to operatively push and pull. A hydraulic jack is preferably used for jacks 38, 40 and 42, however, pneumatic jacks or other jacks may be used.

As shown by exemplary jack 40 in FIG. 1, a front end (cylinder 52 in the illustrated embodiment) of each jack 38, 40 and 42 is connected to a bracket 58 provided on the head portion 14 through a joint 60 so that the front end of each jack 38, 40 and 42 is rotated around the axis extending in the horizontal direction orthogonal to the axial direction of head portion 14. A rear end (rod 56 in the illustrated embodiment) of each jack 38, 40 and 42 is connected to a bracket 62 provided on tail portion 16 through a universal joint 64, so that the rear end of each jack 38, 40 and 42 is rotated around the axis extending in the horizontal direction orthogonal to the axial direction of tail portion 16 and around the axis extending in the vertical direction.

However, the front end of each jack 38, 40 and 42 and head portion 14 may be interconnected to rotate around the axis extending in the horizontal direction orthogonal to the axial direction of head portion 14 and around the axis extending in the vertical direction, and the rear end of each jack 38, 40 and 42 and tail portion 16 may be interconnected to rotate around the axis extending in the horizontal direction orthogonal to the axial direction of tail portion 16. Also, a universal joint may be used for interconnecting the front end of each jack 38, 40 and 42 and head portion 14 and for interconnecting the rear end of each jack 38, 40 and 42 and tail portion 16, to permit rotation of the two interconnected members around two axes orthogonal to each other.

Another connecting structure, for example, a joint disclosed in Japanese Patent Publication No. 61-47956, may be used as the universal joint for interconnecting rod 36 and head portion 14 or tail portion 16 and the universal joint for interconnecting jacks 38, 40 and 42 and head portion 14 or tail portion 16.

As shown in FIG. 2, rod 36 and jacks 38, 40 and 42 are disposed around the axis of tail portion 16 at equal angular intervals (90 degrees) so that their axes are positioned along an imaginary circle 65 coaxial with the axis of tail portion 16. In the illustrated embodiment, rod 36 and jacks 38, 40 and 42 are disposed, such that rod 36 and jack 38 are positioned below jacks 42 and 40. However, rod 36 may be disposed in any of the positions of jacks 38, 40 and 42. Also, rod 36 and jacks 38, 40 and 42 may be disposed, such that rod 36 and jack 38 are positioned upward, leftward or rightward of jacks 42 and 40.

When jacks 40 and 42 are simultaneously contracted, head portion 14 is directed upward relative to tail portion 16. When jacks 40 and 42 are simultaneously extended, head portion 14 is directed downward relative to tail portion 16. When jacks 38 and 40 are simultaneously contracted, head portion 14 is directed leftward relative to tail portion 16. When jacks 38 and 40 are simultaneously extended, head portion 14 is directed rightward relative to tail portion 16.

A load acting between head portion 14 and tail portion 16 in direction correcting and advancing operations is dispersed in rod 36 and jacks 38, 40 and 42. Thus, by use of one rod and three jacks, smaller-sized jacks may be used in comparison with the prior art device having one rod and two jacks, and equipment, such as piping for pressure fluid, i.e., working fluid, is simplified in comparison with the prior art device including four jacks.

By equalizing the extended and contracted amounts of jacks 40 and 42 when head portion 14 is corrected vertically relative to tail portion 16 to those of jacks 38 and 40 when head portion 14 is corrected leftward or rightward relative to tail portion 16, the correcting amount in the vertical direction and that in the leftward or rightward direction are equalized. Therefore, if one rod 36 and three jacks 38, 40 and 42 are disposed at equally angular intervals, the correcting operation is facilitated.

In the prior art device using one rod and two jacks, the leftward or rightward correction is performed by extending one jack and contracting the other jack, and the upward or downward correction is performed by simultaneously extending or contracting both jacks, so that when the extended and contracted amounts of both jacks are set to be equal to each other, the upward or downward correcting amount is largely degraded in comparison with the leftward or rightward correcting amount. As a result, complicated control of the extended and contracted amounts of both jacks must be employed to make the upward or downward correcting amount equal to the leftward or rightward correcting amount.

Figure 3:
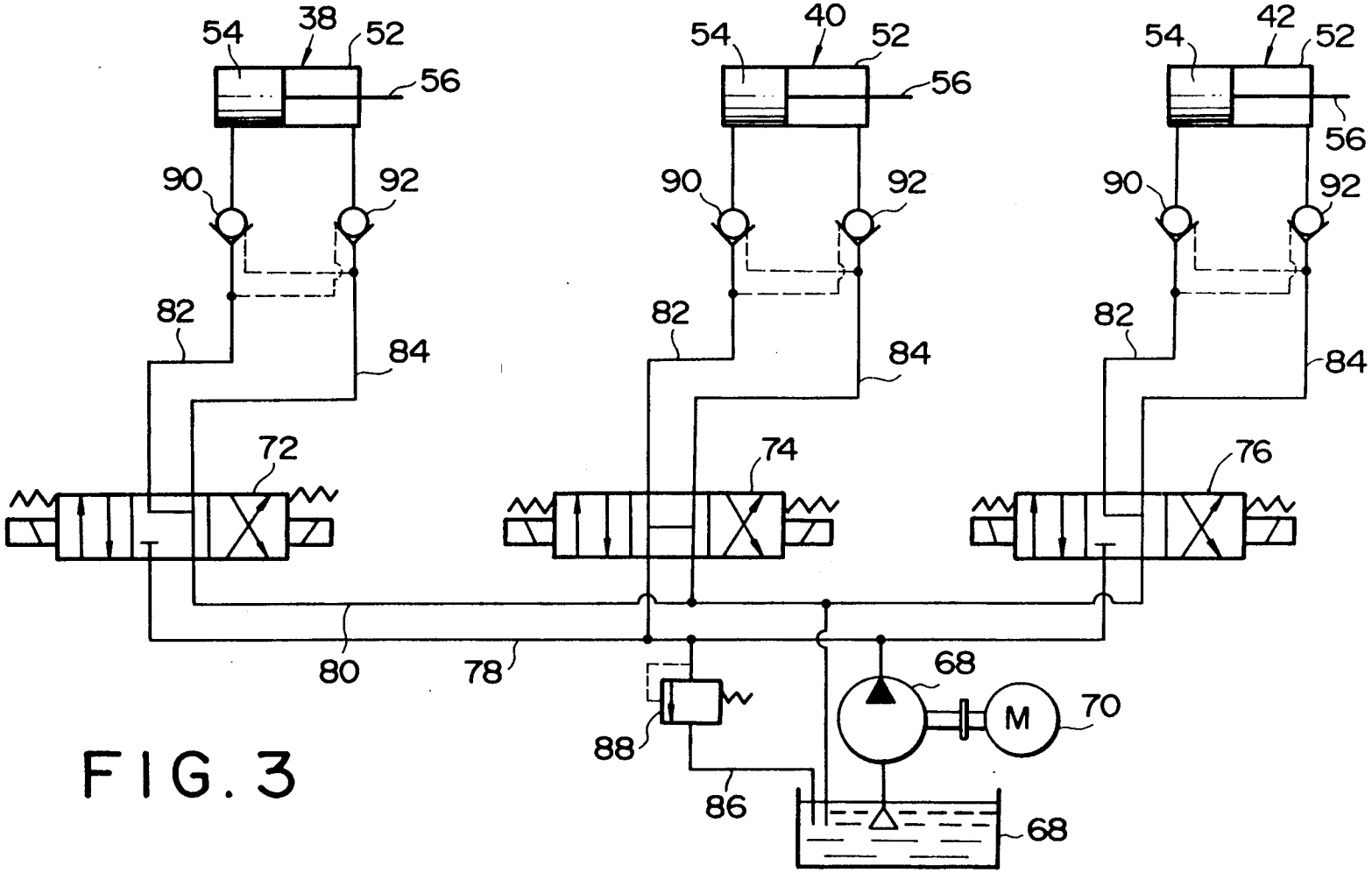
FIG. 3 is a circuit diagram of an embodiment of a fluid circuit of the direction correcting device of the present invention.

Referring to FIG. 3, a fluid circuit for working fluid, such as operating oil, for operating jacks 38, 40 and 42 includes a tank 66 for storing the working fluid; a pump 68 communicating with tank 66; a motor 70 for rotating pump 68; and directional control valves or change-over valves 72, 74 and 76 disposed for jacks 38, 40 and 42.

Each change-over valve 72 and 76 is a P-port, block type, three-position, four-port solenoid operated change-over valve, while change-over valve 74 that is operated simultaneously with one of change-over valves 72 and 76 is an open center type, three-position, four-port solenoid operated change-over valve.

Each change-over valve 72, 74 and 76 has one port communicating with a working fluid outlet of pump 68 through a common pipe 78; another port communicating with tank 66 through a common pipe 80; another port communicating with an extension-side liquid chamber of the corresponding jack through a pipe 82; and another port communicating with a contraction-side liquid chamber of the corresponding jack through a pipe 84. Pipe 78 communicates with tank 66 through a pipe 86 and a relief valve 88.

Check valves 90 and 92 are disposed in the pipes 82 and 84, respectively. Each check valve 90 and 92 is a pilot check valve, which permits the working fluid to enter the corresponding liquid chamber and blocks the working fluid from flowing out of the corresponding liquid chamber through the corresponding pipe. Also, each check valve 90 and 92 permits the working fluid to flow out of the corresponding liquid chamber through the corresponding pipe when pressure is applied to the other pipe.

When head portion 14 is directed upward relative to tail portion 16, each change-over valve 74 and 76 is operated to interconnect corresponding pipes 78 and 84. When head portion 14 is directed downward relative to tail portion 16, each change-over valve 74 and 76 is operated to interconnect corresponding pipes 78 and 82. When head portion 14 is directed leftward relative to tail portion 16, each change-over valve 72 and 74 is operated to interconnect corresponding pipes 78 and 84. When head portion 14 is directed rightward relative to tail portion 16, each change-over valve 72 and 74 is operated to interconnect corresponding pipes 78 and 82.

When jacks 38 and 40 (or 40 and 42) are extended or contracted, pipes 82 and 84 connected to the liquid chambers of other jack 42 (or 38) are closed by corresponding check valves 90 and 92. In this manner, jack 42 (or 38) is neither extended nor contracted, so that jack 42 (or 38) serves as a means for interconnecting head portion 14 and tail portion 16 similar to connecting rod 36.

According to the fluid circuit shown in FIG. 3, change-over valve 74 corresponding to jack 40 disposed opposite to rod 36 is an open center type, three-position four-port change-over valve, while change-over valves 72 and 76 corresponding to jacks 38 and 42 are P-port, block type change-over valves, so that pump 68 is always operated without hindering the normal operation of each jack 38, 40 and 40 and without using an unloading valve.

Figure 4:
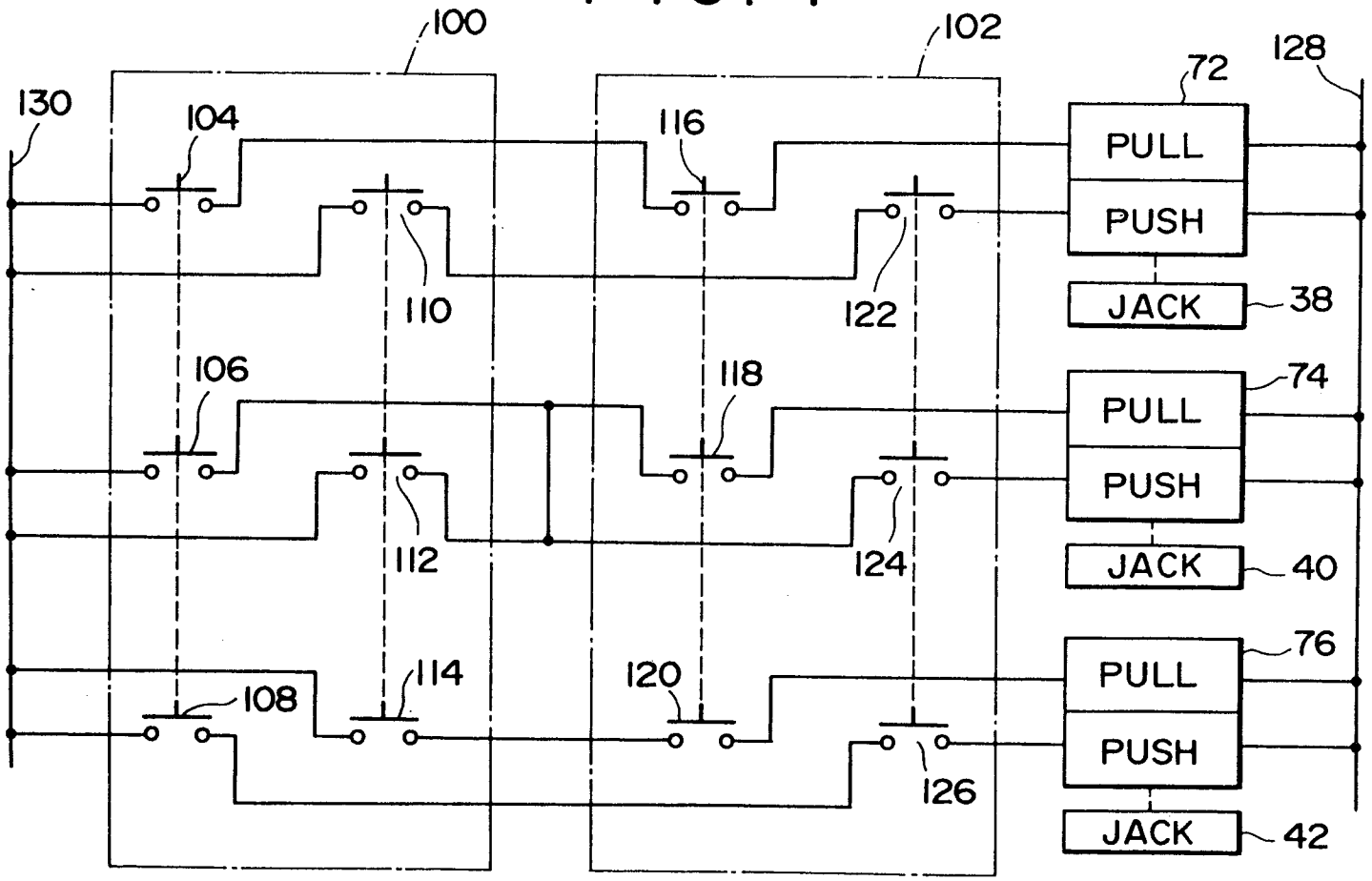
FIG. 4 is a circuit diagram of an embodiment of a control circuit of the direction correcting device of the present invention.

Referring to FIG. 4, a control circuit for change-over valves 72, 74 and 76 includes two sets of change-over switches 100 and 102. Change-over switches 100 and 102 have six normal open type switch portions 104, 106, 108, 110, 112 and 113 and 116, 118, 120, 122, 124 and 126, respectively. The switch portions of each change-over switch 100 and 102 are divided into two groups, each of which consists of three switch portions.

Each change-over switch 100 and 102 is manually changed over from a neutral position, where any switch portions are opened, into a first position, where switch portions in one group are closed, and into a second position, where switch portions of the other group are closed.

Each switch portion of change-over switch 100 is made to correspond to one coil of change-over valve 72, 74 or 76 together with one switch portion of change-over switch 102 and is connected in series to power supply paths 128 and 130 together with the corresponding coil. An intermediate point between switch portions 106 and 118 and an intermediate point between switch portions 112 and 124 are short-circuited.

When both change-over switches 100 and 102 are in their neutral positions, no switch portions are closed, so that change-over valves 72, 74 and 76 are not operated.

When change-over switches 100 and 102 are changed over into their first positions, switch portions 104, 106 and 108 and switch portions 116, 118 and 120 are closed. Thus, change-over valves 72 and 74 operatively pull jacks 38 and 40, so that head portion 14 is displaced leftward relative to tail portion 16.

When change-over switches 100 and 102 are changed over into their second positions, switch portions 110, 112 and 114 and switch portions 122, 124 and 126 are closed. Thus, change-over valves 72 and 74 operatively push jacks 38 and 40, so that head portion 14 is displaced rightward relative to tail portion 16.

When change-over switch 100 is changed over into the first position and change-over switch 102 is changed over into the second position, switch portions 104, 106 and 108 and switch portions 122, 124 and 126 are closed. Thus, change-over valves 74 and 76 operatively push jacks 40 and 42, so that head portion 14 is displaced downward relative to tail portion 16.

When change-over switch 100 is changed over into the second position and change-over switch 102 is changed over into the first position, switch portions 110, 112 and 114 and switch portions 116, 118 and 120 are closed. Thus, change-over valves 74 and 76 operatively pull jacks 40 and 42, so that head portion 14 is displaced obliquely upward relative to tail portion 16.

According to the control circuit shown in FIG. 4, the direction of head portion 14 relative to tail portion 16 is corrected by changing over two switches 100 and 102 into the first or second position, so that the correcting operation is facilitated.

What is claimed is:

1. A direction correcting device for a shield tunnelling machine having a shield body provided with a head portion and a tail portion following the head portion, comprising:

four connecting means disposed around an axis of said tail portion at angular intervals, where three of the four connecting means are provided with a jack having two connecting portions relatively displaceable in the axial direction of said tail portion, each jack being connected at one of said connecting portions to said head portion and at the other of said connection portions to said tail portion; and the fourth connecting means is provided with a connecting body having two connecting portions incapable of relative displacement in the axial direction, the connecting body being interconnected at one of said connecting portions to said head portion and at the other of said connecting portions to said tail portion to permit said head and tail portions to relatively swing and to prevent said head and tail portions from relatively displacing in the axial direction.

2. A direction correcting device for a shield tunnelling machine according to claim 1, wherein said jacks and said connecting body are disposed along an imaginary circle around the axis of said tail portion at equal angular intervals.

3. A direction correcting device for a shield tunnelling machine according to claim 1, wherein each of said jacks is a double-acting hydraulic jack having a first liquid chamber and a second liquid chamber defined by a piston sliding within a cylinder.

4. A direction correcting device for a shield tunnelling machine according to claim 3, wherein said device further comprises:

a pump for supplying pressurized fluid to said jacks to operate said jacks;

three solenoid operated change-over valves corresponding to each of said jacks and disposed between said jack and said pump to change over paired first and second pressurized fluid flow paths, said first and second flow paths being individually connected to said first or second liquid chambers;

a control circuit for controlling current applied to said change-over valves; and check valves disposed in said flow paths permitting said pressurized fluid to be supplied to said first or second liquid chamber and preventing said pressurized fluid from flowing out of said liquid chamber, said check valves permitting said pressurized fluid to flow out of said liquid chamber when pressure acts on the flow path paired with the flow path corresponding to said liquid chamber.

5. A direction correcting device for a shield tunnelling machine according to claim 4, wherein two change-over valves corresponding to jacks adjacent to said connecting body are P-port, block type valves, and the third change-over valve corresponding to the third, non adjacent jack is an open center type, three-position four-port valve.

6. A direction correcting device for a shield tunnelling machine according to claim 1, wherein said connecting body includes a rod having both said connecting portions.

* * * * *